United States Patent [19]

Oussani

[11] 4,419,915

[45] Dec. 13, 1983

[54] ENVELOPE OPENER DEVICE

[75] Inventor: James J. Oussani, Brooklyn, N.Y.

[73] Assignee: The Staplex Company, Inc., Brooklyn, N.Y.

[21] Appl. No.: 340,696

[22] Filed: Jan. 19, 1982

[51] Int. Cl.[3] ..... B43M 7/02

[52] U.S. Cl. ..... 83/887; 83/881; 83/433; 83/506; 83/912

[58] Field of Search ..... 83/879, 880, 881, 886, 83/887, 431, 505, 506, 912, 433

[56] References Cited

U.S. PATENT DOCUMENTS

| | | | |
|---|---|---|---|
| 2,019,499 | 11/1935 | Mahzl | 83/887 |
| 3,055,248 | 9/1962 | Burdwood | 83/506 X |
| 3,153,853 | 10/1964 | Lipton | 83/912 X |
| 3,165,951 | 1/1965 | Lindquist | 83/887 |
| 3,240,089 | 3/1966 | Chamberlain | 83/431 |
| 3,381,564 | 5/1968 | Whiteford | 83/912 X |
| 4,016,708 | 4/1977 | Daltart | 83/912 X |

*Primary Examiner*—James M. Meister

*Attorney, Agent, or Firm*—Mark T. Basseches; Paula T. Basseches

[57] ABSTRACT

An envelope opener device is provided characterized in that the envelope, which is automatically fed, is slit through only a single face of the envelope whereby no portion of the envelope is severed entirely, thus minimizing the possibility of loss of the contents. A further characterizing feature resides in a unique device for adjusting the cutting depth to achieve a precisely desired cutting effect, the depth adjustment means being actuatable for the slitting of envelopes of thinner stock, such as air mail envelopes. The device is resistant to feeding an envelope which is so disposed that the envelope contents are in registry with the cutting mechanism, thereby minimizing the possability of damaging the contents.

4 Claims, 10 Drawing Figures

ENVELOPE OPENER DEVICE

BACKGROUND OF THE INVENTION

1. Field of the Invention

The present invention is in the field of envelope slitting devices and pertains more particularly to an envelope slitter which cuts through less than the entire thickness of an envelope whereby the formation of scrap and damage to the envelope contents is avoided.

2. The Prior Art

Various paper processing devices are known which function to open envelopes. By way of example, reference is made to the following United States Letters Patent:

U.S. Pat. Nos. 1,150,905—2,019,499—3,153,8-53—3,381,564—4,016,708

In known devices the opener has typically removed an entire segment or increment of the envelope adjacent a margin thereof. Envelope operners operating on such principle are disadvantageous in that substantial scrap accumulations result. Accumulated scrap may fall into the mechanism of the slitter, requiring its frequent cleaning.

More significantly, powerized envelope openers heretofore known may, in the course of removing an increment of the envelope, also cut through and sever portions of the contents of the envelope where the contents may have shifted within the envelope to a position adjacent the edge to be severed. The undesirable nature of such occurrence is manifest.

SUMMARY OF THE INVENTION

The present invention may be summarized as directed to an improved envelope slitting device characterized in that no portion of the envelope is completely removed but, rather, a cut or slit is defined through a main face of the envelope at a portion adjacent the margin of the envelope. In this manner the slit envelope cannot inadvertently discharge its contents since the contents are still surrounded by portions of the envelope.

Additionally, the accumulation of scrap experienced with conventional opening devices is eliminated since no portion of the envelope is completely severed.

Further, by virture of only a partial penetration of the severing element into the interior of the envelope, no portion of the contents will be severed. If through some mischance the contents of the envelope have shifted or are oriented in the path of the slit to be formed, the envelope will not be advanced through the slitting station.

More particularly the invention relates to a slitter device which comprises a feed table for supporting an envelope, a driven rotary knife cutter wheel extending upwardly through the feed table adjacent a guide fence, a hold down wheel in proximate spaced relation to the knife periphery, the spacing of the wheel and the periphery being adjusted such that an envelope passing through the nip between the wheel and periphery will be partially slit, i.e. slit through the single uppermost layer most closely adjacent to the knife.

The device is characterized by a unique micrometer adjustment arrangement whereby the critical spacing between the hold down wheel and the knife may be accurately and repeatably set.

The device is further characterized by a manually actuatable member which functions, where envelopes of especially thin stock are to be processed, to shift the hold down roller to a position more closely adjacent the knife.

The envelope is fed through the sliter station by the driving action of the knife, and the device resists through-feed if the envelope exceeds a predetermined thickness signifying that contents of the envelope are interposed between the knife and wheel.

It is accordingly an object of the invention to provide an improved envelope slitting device which prevents the formation of scrap, and avoids the complete removal of edge portions of an envelope.

It is a further object of the invention to provide a device of the type described wherein, after opening of the envelope, the envelope still serves a contents-retaining function due to the continued presence of all portions of the original envelope.

Still a further object of the invention is the provision of a device of the type described wherein a critical separation distance between knife and hold down roller may be accurately and repeatably set and wherein, by simple manual operation, compensation may be made to permit the effective processing of thin stock envelopes, such as airmail envelopes.

Still a further object of the invention is to provide a device of the type described which resists feed where the thickness of the envelope portion presented exceeds a preset value, thus precluding cutting through increments of the envelope contents.

To attain these objects, reference is made to the accompanying drawings, wherein.

Figure 1:
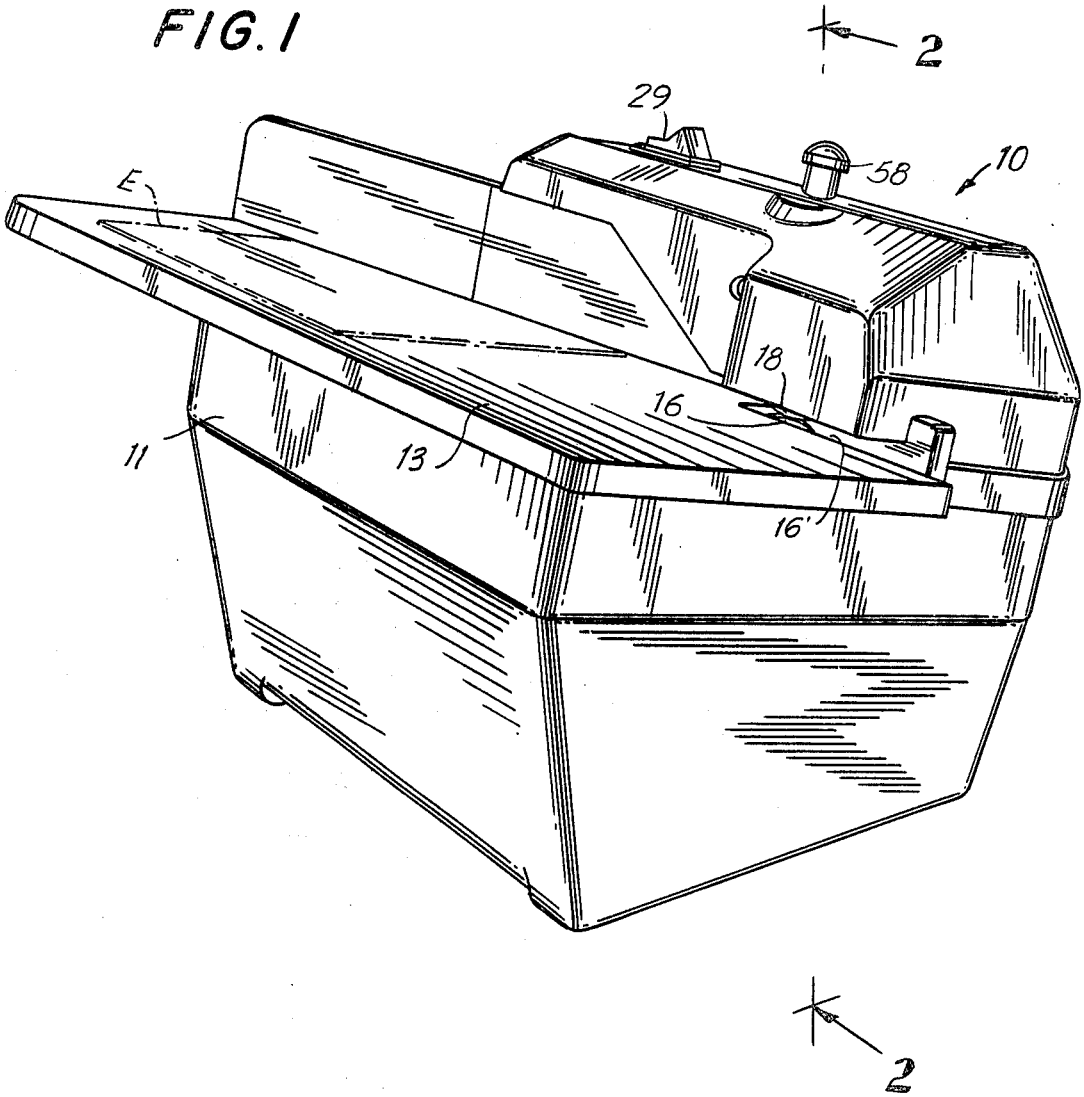
FIG. 1 is a perspective view of an envelope slitting apparatus in accordance with the invention.

Referring now to the drawings, there is shown in FIG. 1 an envelope slitting device comprising a housing 10 including a base frame portion 11 to which is affixed a fence plate 12. A cutter table 13 forms part of the casing.

Figure 2:
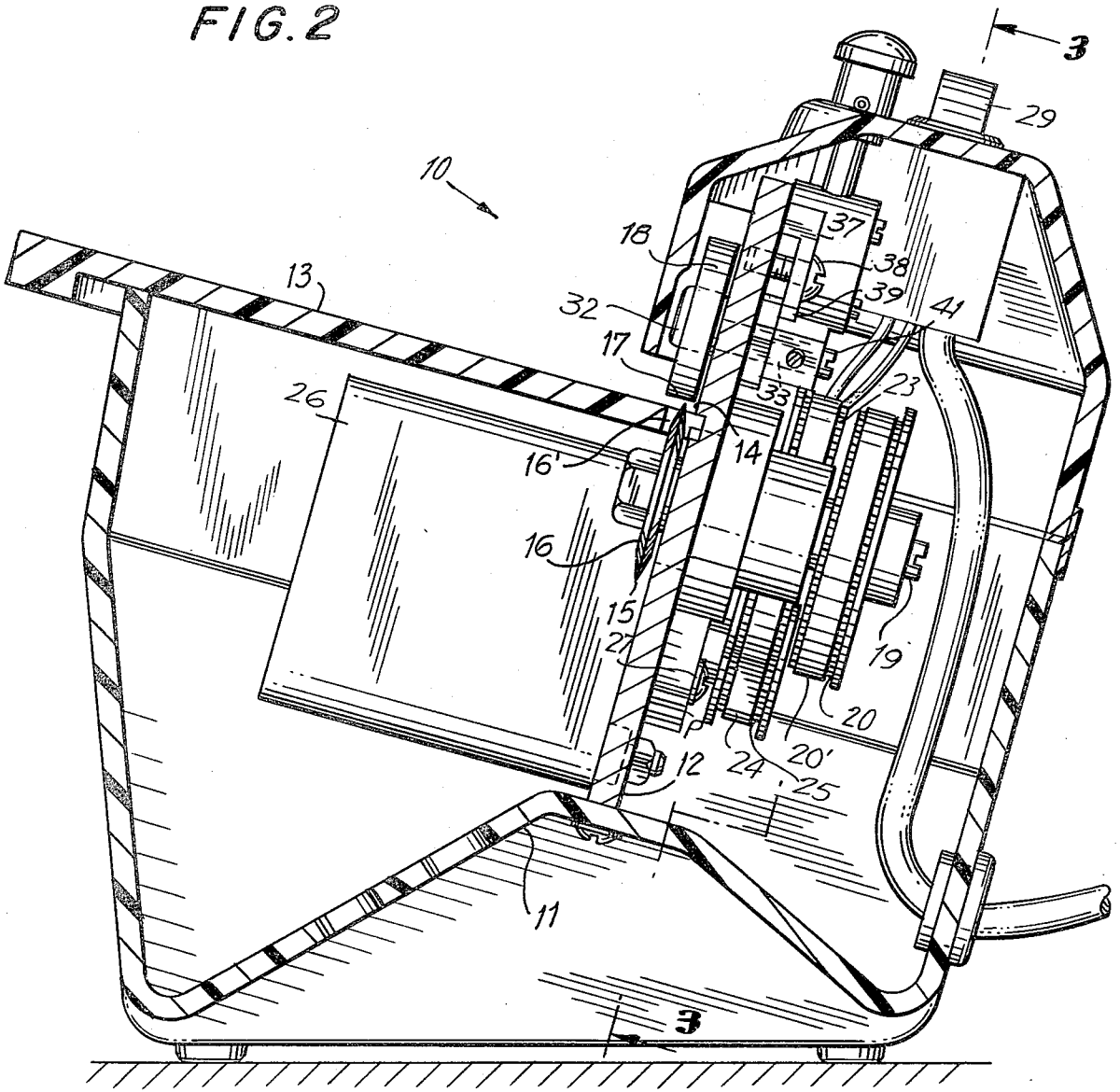
FIG. 2 is a longitudinal sectional view taken on the line 2—2 of FIG. 1.

As will be best appreciated from an inspection of FIGS. 1 and 2, the table 13 and fence plate 12 are elongated in a horizontal direction and meet each other in an included angle of substantially 90°. Table 13 is inclined downwardly toward the plate 12, with the result that envelopes (E), placed over the table will tend to move toward and be guided against the guide surface portion 14 of the fence plate, i.e. the portion immediately at the junction of the plate and the table.

The actual slitting of an envelope is effected by passing the same between peripheral portion 15 of rotary knife 16 and the undersurface portion 17 of hold down wheel 18. As will be appreciated from the ensuing description, the knife 16 is rotated by a motor and drive mechanism in the direction of the arrows, FIG. 3. The knife 16 is preferably of tungsten carbide or like extremely hard and wear-resistant material.

The knife 16 is mounted on shaft 19, rotatably supported in a bushing extending through the fence plate 12. The knife, a peripheral portion of which extends upwardly though aperture 16' in Table 13, is driven by a drive train which includes a serrated pulley or gear 20 made fast to the shaft 19, the pulley being joined to a smaller diametered pulley 21 mounted on adjustment plate P by a first drive belt 20' mounted on shaft 22 fixed to adjustment plate P.

In turn, the shaft 22 carries a larger diametered pulley 23 linked by belt 24 to the output pulley 25 of the gear reduction unit of a motor-drive mechanism 26 secured to the plate 12.

Preferably the speed reduction of the described motor-drive and pulley cluster is such as to drive the periphery 15 of the knife 16 at a linear speed of aproximately 20 to 30 inches per second.

As will be perceived from the foregoing, tension in the pulleys 20' and 24 may be adjusted by adjustably positioning plate P such movement being made possible by the sliding connection afforded between the plate P and fence 12 by retainer screws 27, 27 which extend through complemental slots 28, 28 in the plate P.

It will be evident that alternative drive means may be supplied to rotate the knife at the desired lineal peripheral speed, the described drive shown forming no part of the present invention.

The power to the drive motor 26 may be controlled by switch mechanism 29.

Figure 4:
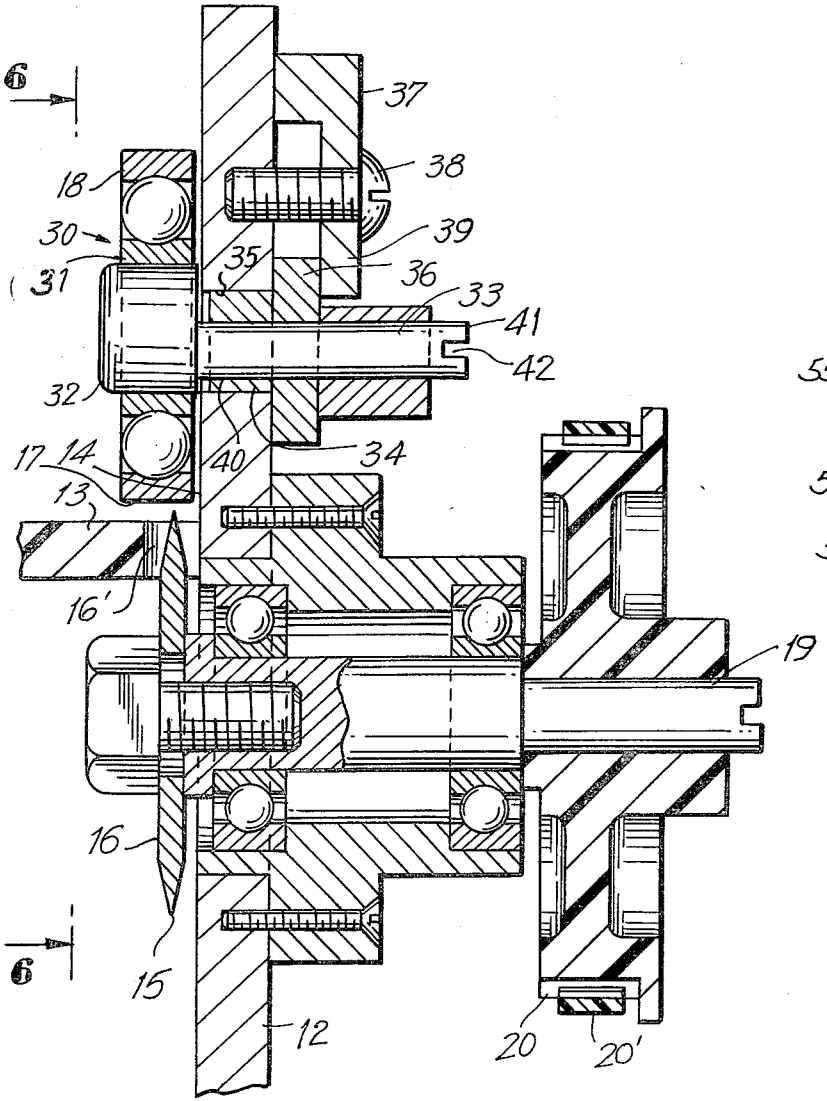
FIG. 4 is a fragmentary magnified vertical section taken on the line 4—4 of FIG. 3.
Figure 7:
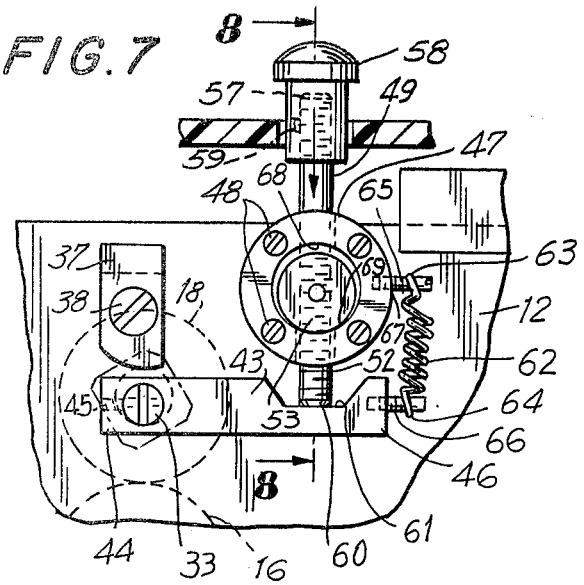
FIG. 7 is a side elevational view of the adjustment components of the apparatus positioned to slit thinner stock envelopes.

The hold down wheel 18, as may best be seen from FIGS. 2, 4 and 7, comprises the outer race of a ball bearing assembly 30, the inner race 31 of which is mounted to a stub shaft 32. Stub shaft 32 includes an extension shaft 33. The axes of shafts 32 and 33 are parallel but are displaced one from the other, i.e. the shaft 33 is eccentrically located as respects the shaft 32.

The shaft 33 is passed through a bushing 34 extending through aperture 35 formed in the fence 12. The bushing 34 includes a flange 36, said bushing being held in position as by tightening L bracket 37 against fence 12, utilizing a machine screw 38. In such orientation the leg 39 of the inverted bracket 37 binds the flange 36 of the bushing in position. Preferably, the extension shaft 33 forms a tight fit within the aperture 40 of bushing 34. The end 41 of the extension shaft 33 may be bifurcate, as at 42, to provide an adjustment slot.

From the preceding description it will be perceived that any rotation of the shaft 33 by reason of its eccentricity as respects the stub shaft 32 will cause the hold down wheel 18 to be moved closer or further from the periphery of the knife 16.

Figure 3:
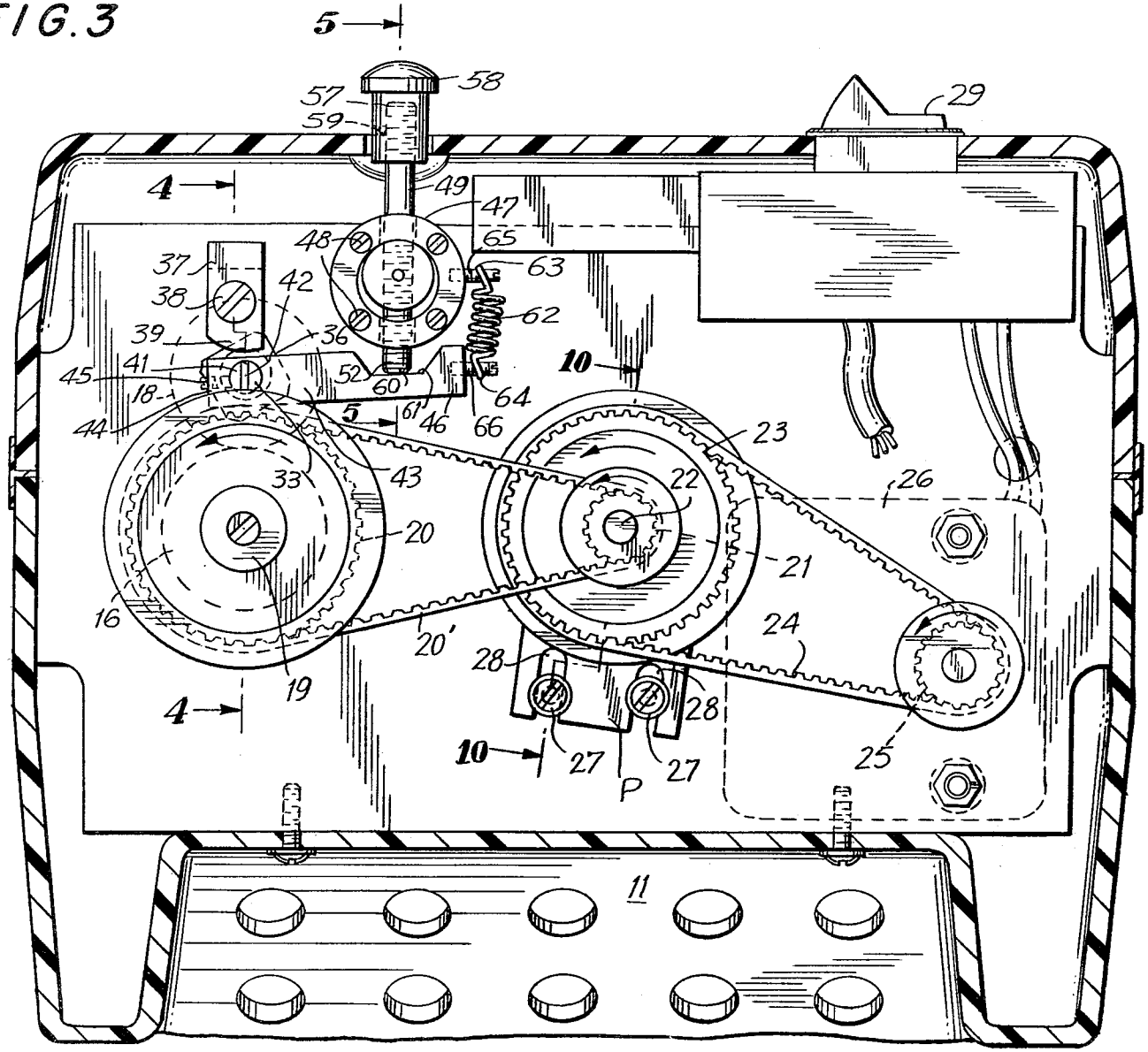
FIG. 3 is a transverse sectional view taken on the line 3—3 of FIG. 2.
Figure 6:
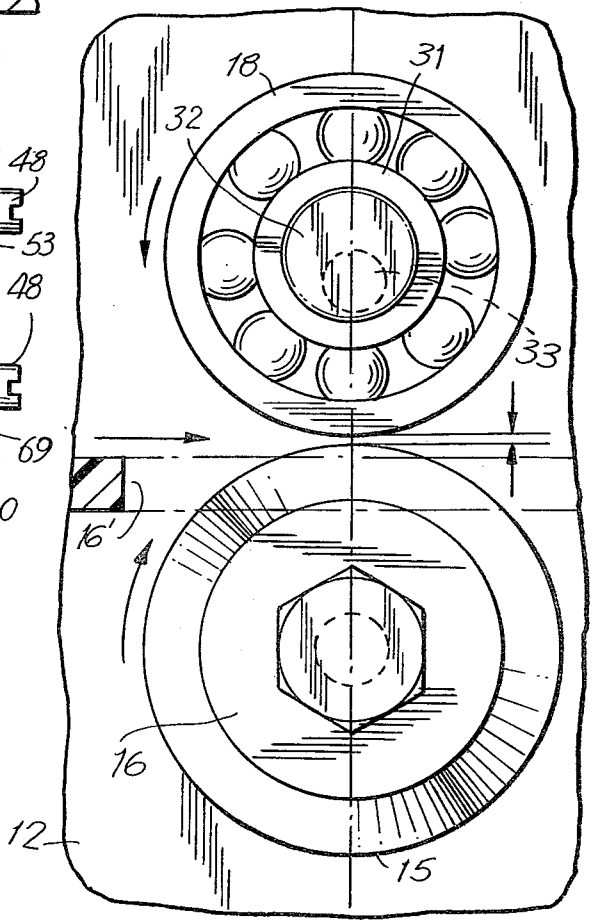
FIG. 6 is a vertical section taken on the line 6—6 of FIG. 4.
Figure 5:
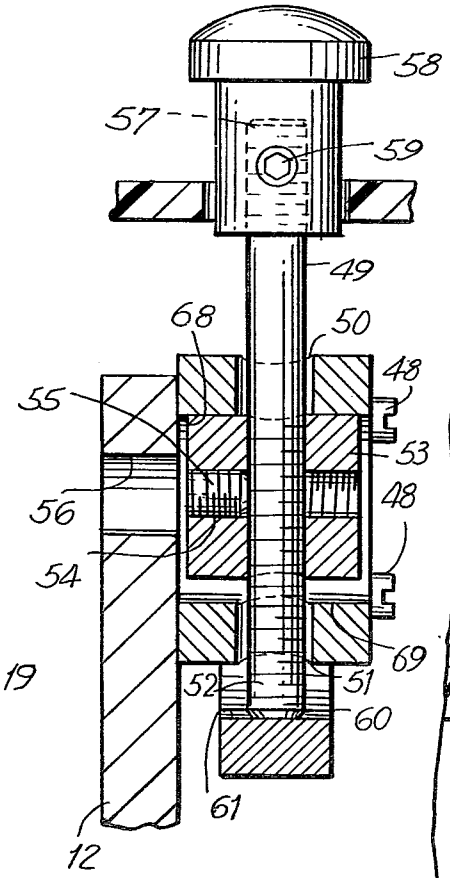
FIG. 5 is a fragmentary magnified vertical section taken on the line 5—5 of FIG. 3.

Referring now to FIGS. 3 and 7, it will be seen that an adjustment lever 43 is provided, the end 44 of the lever being made fast to the extension shaft 33 as by grub screw 45 threaded in the lever and bearing against the shaft 33.

The lever includes a free end portion 46, it being understood that the end 46 may be moved in an arcuate path defined by the axis of the extension shaft 33.

Figure 8:
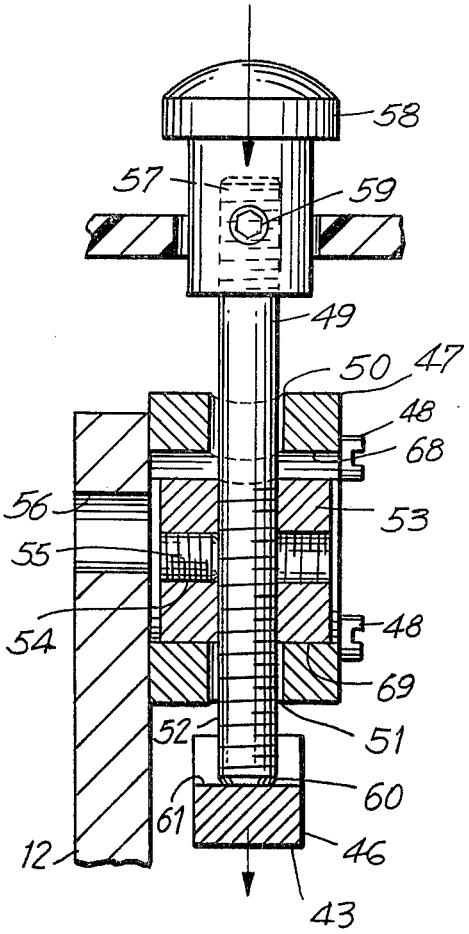
FIG. 8 is a magnified section taken on the line 8—8 of FIG. 7.
Figure 9:
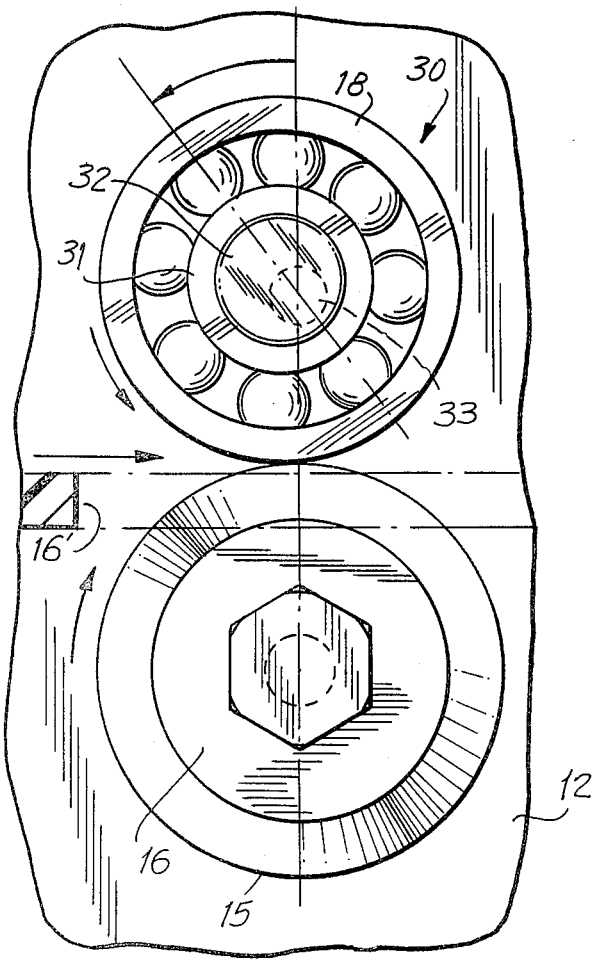
FIG. 9 is a view similar to FIG. 6 showing the position of the parts when the device is on the thin envelope slitting condition.
Figure 10:
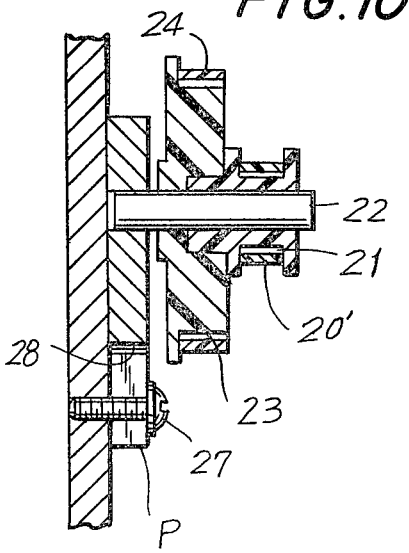
FIG. 10 is a discontinuous section taken on the line 10—10 of FIG. 3.

An annular member 47 is fixed to the fence 12 as by machine screws 48, FIG. 8. An adjustment plunger 49 extends through vertically aligned apertures 50, 51 in the member 47.

The adjustment plunger 49, which is threaded along its exterior surface portion 52 extends through a complemental internally threaded abutment member 53. The abutment member, which is preferably circular in vertical section, is provided with a threaded central aperture 54 within which a locking grub screw 55 is mounted.

The fence 12 is provided with an access aperture 56 which enables the grub screw to be shifted to clamping or releasing position as desired by an appropriate tool inserted through the wall.

To the upper end 57 of the plunger 49 is mounted a knob 58 keyed against rotation relative to the plunger as by an Allen screw 59. The lower end 60 of the plunger 49 is disposed in alignment with a recess 61 adjacent the free end 46 of the lever 43. The recess area 61 is urged upwardly into contact with the free end 60 of the plunger, as by spring member 62, the distal ends 63,64 of which are hooked over stress pins 65,66, respectively, secured to annulus 67 and the free end 46 of the lever, respectively.

As is apparent from a comparison of FIGS. 7 and 8, the lever 43 may be moved through an arcuate increment defined by the engagement of the upper and lower surfaces of abutment member 53 with the upper and lower shoulders on surfaces 68, 69, respectively of the annulus 47.

The operation of the device will be apparent from the preceding description.

As a preliminary adjustment, the spacing of the lower surface 17 of the hold down wheel 18 from the upper surface or periphery of the knife must be established. Such distance should preferably be set to approximately the thickness of a single layer of stock of the type normally processed.

The adjustment to the dimension noted may be readily accomplished by releasing the grub screw 55 accessible through aperture 56 in the fence 12 and rotating the plunger 49 about its major axis. As will be evident, such rotary movement will cause the lever 43 to be pivoted minor amounts upwardly or downwardly in accordance with the direction of rotation and thus induce concomitant rotary movement of the extension shaft 33. Rotary movement of the shaft 33 will, in turn, introduce an upward or downward movement of the wheel 18 due to the eccentricity of the shafts 33 and 32. When the desired adjustment is achieved, the grub screw 55 is tightened.

The device may now be used by activating the switch 29 and causing envelopes which are aligned against the fence 12 to move in a left to right direction when viewed in the orientation of FIG. 1 until the lead edge of an envelope engages in the nip between periphery 17 of wheel 18 and the cutting edge 15 of the knife 16.

The knife 16, as seen in FIG. 2, projects a slight distance above the table through the opening 16', the cutting edge of the knife being spaced from the guide edge of the table 12 a lateral distance calculated to leave, after slitting, a short section of the lower layer of stock adjacent the margin of the envelope. By this means the slit envelope still functions as a container of its contents and the papers enclosed therewithin not liable to fall out of the envelope.

When it is desired to slit an envelope of thinner than usual stock, e.g. an airmail envelope, the knob 58 is depressed to the position shown in FIGS. 7 and 8 whereby a slight clockwise movement of lever 43 is effected and a concomitant slight lowering of the hold down wheel toward the knife results.

This depressed position is accurately and repeatably established by the engagement of the abutment 53 mounted on plunger 49 against the lower shoulder 69 defined by the interior of the annulus 47.

As soon as the thin stock envelope has been slit, the knob may be released, whereupon it assumes its normal slitting position.

The envelopes are self fed by virtue of the rotary movement imparted to the envelopes by the rotating knife and are drawn acroess the nip between the knife and the wheel, to be discharged after slitting to a discharge station downstream of the knife.

Obviously, stacking and receiving trays may be positioned upstream and downstream of the table.

From the foregoing it will be apparent that there is disclosed in accordance with the present invention a slitter apparatus for opening envelopes wherein no increment of the envelope is completely removed and thus scrap is not formed. The envelope so slit nonetheless maintains a containing function and it is thus unlikely that the contents of an envelope could be inadvertently discharged.

The possibility of damage to the contents of an envelope is minimized. A contributing factor to such minimization is that if, by mischance, the contents of an envelope should be bunched against that margin of the envelope which lies closest to the fence, so that the overall thickness presented materially exceeds the thickness of two stock layers, the envelope simply will not feed until the operator shakes the envelope to clear the contents from the edge to be slit or, in the alternative, rotates the envelope such that only two thickness of stock are presented to the slitter.

This action occurs since the holddown wheel cannot be forced upwardly by the minor feeding forces of the rotating knife.

The device incorporates means for accurately and repeatably adjusting the spacing of the knife from the hold down wheel, and it has been found, in practice, that such adjustments need be effected only infrequently, i.e. once a month or even less.

As will be evident to those skilled in the art and acquainted with the instant disclosure, numerous variations and modifications may be made in the illustrated embodiment without departing from the spirit of the invention. Accordingly, the invention is to be broadly construed within the scope of the appended claims.

The embodiments of the invention in which an exclusive property or privilege is claimed are defined as follows:

1. An envelope opener device for effecting a slit adjacent a margin through the upper layer only of an envelope or the like comprising a planar support table having its longitudinal axis arrayed in a horizontal plane and having its transverse axis inclined to the horizontal to define upper and lower marginal side edges, a stop fence in abutting relation to the lower marginal edges of said table, said fence being disposed substantially at right angles to said table, an aperture formed in said table in proximate spaced relation to said fence, a circular rotary knife member including a sharpened peripheral portion extending upwardly through said table, said knife member projecting upwardly beyond said table a distance at least equal to the thickness of the paper of the envelope to be processed, drive means for rotating said knife member about an axis of rotation parallel to the plane of said table and normal to the longitudinal axis of said table, a bushing mounted above said table and including an aperture, a stub shaft including an extension shaft rotatably mounted in said aperture, said stub shaft and extension shaft having parallel, laterally offset axes, a holddown wheel mounted on said stub shaft, said wheel being rotatable about said stub shaft about an axis parallel to the axis of rotation of said knife, the periphery of said wheel being spaced from the periphery of said knife a first preset distance less than the thickness of the stock of an envelope to be processed, and adjustment means for rotating said extension shaft relative to said bushing, thereby to shift said hold-down wheel from said first preset distance to a second and closer preset distance from said knife periphery for the processing of envelopes formed of thinner stock than said first preset distance.

2. Apparatus in accordance with claim 1 wherein said adjustment means includes a lever having a first end keyed to said extension shaft and a free end, and limit means to shift said free end in an accurate path about the axis of said extension shaft, thereby to pivot said extension shaft within said bushing.

3. Apparatus in accordance with claim 2 wherein said limit means comprises a plunger slidably guided for movement in a direction substantially normal to the plane of said table, said plunger having a depending end portion engaging said lever, said plunger including a lengthwisely extending threaded portion, an abutment member threadedly connected to said threaded portion of said plunger, first and second stop shoulders disposed to opposite sides of said abutment member, spring means operatively connected to said lever for biasing said lever against said end portion of said plunger and said abutment means against one said stop shoulder to define a position corresponding to said first preset distance of said wheel from said knife periphery, said plunger being shiftable against the force of said spring means to shift said abutment means against the other said shoulder whereby said wheel is shifted to said second preset distance from said shoulder.

4. Apparatus in accordance with claim 3 wherein rotation of said plunger about its longitudinal axis relative to said abutment effects longitudinal shifting movement of said abutment relative to plunger, whereby to control said preset distances.

* * * * *